US011272273B2

(12) United States Patent
Liu et al.

(10) Patent No.: US 11,272,273 B2
(45) Date of Patent: Mar. 8, 2022

(54) SHELL AND SIGNAL TRANSMISSION APPARATUS USING THE SHELL

(71) Applicant: HOCHENG CORPORATION, Pa-Te (TW)

(72) Inventors: Che-Yuan Liu, Pa-Te (TW); Chang-Hsing Lee, Pa-Te (TW); Ming-Chuan Liu, Pa-Te (TW); Zhao-Xu Lai, Pa-Te (TW); You-Ning Hsiung, Pa-Te (TW); Chia-Chang Hsu, Pa-Te (TW); Pen-Chien Yu, Pa-Te (TW); Shu-Fen Wang, Pa-Te (TW)

(73) Assignee: HOCHENG CORPORATION, Taipei (TW)

( * ) Notice: Subject to any disclaimer, the term of this patent is extended or adjusted under 35 U.S.C. 154(b) by 0 days.

(21) Appl. No.: 16/986,843

(22) Filed: Aug. 6, 2020

(65) Prior Publication Data

US 2022/0046347 A1 Feb. 10, 2022

(51) Int. Cl.
*H04R 1/02* (2006.01)

(52) U.S. Cl.
CPC ..... *H04R 1/025* (2013.01)

(58) Field of Classification Search
CPC ..... H04R 1/025
USPC ..... 381/332
See application file for complete search history.

(56) References Cited

U.S. PATENT DOCUMENTS

2004/0028253 A1* 2/2004 Hanna ..... H04R 25/652 381/322
2007/0160246 A1* 7/2007 Vollmer ..... H04R 1/323 381/336
2016/0021464 A1* 1/2016 Fukuoka ..... H04R 17/00 381/160

* cited by examiner

*Primary Examiner* — Sean H Nguyen
(74) *Attorney, Agent, or Firm* — Muncy, Geissler, Olds & Lowe, P.C.

(57) ABSTRACT

A signal transmission apparatus comprises a base and a shell, wherein a top portion of the base has a signal transmission device. The shell is covered above the base. A cavity is formed inside the shell. The cavity is in communication with an opening of a bottom portion of the shell. And the shell comprises a ceramic shell body and an inner covering layer. The inner covering layer is fully attached to an inner surface of the ceramic shell body. Therefore, the signals of the signal transmission device can pass through the shell so that the signal transmission device can receive or transmit signals. And through the strong adhesion of the inner covering layer, the ceramic shell body can be kept intact without being broken into a lot of debris when the ceramic shell body is impacted by external force or suddenly dropped.

8 Claims, 4 Drawing Sheets

SHELL AND SIGNAL TRANSMISSION APPARATUS USING THE SHELL

FIELD OF THE INVENTION

The present invention is related to a shell and a signal transmission apparatus using the shell, especially a shell having an inner covering layer strongly connected with an inner surface of the ceramic shell body to avoid the danger of ceramic shell body cracking.

BACKGROUND OF THE INVENTION

Currently a shell of the signal transmission apparatus common in the market, such as a transceiver, is mostly one-piece manufactured with plastic or metal materials for being sleeved on an outer surface of a signal transmission device to achieve the protection function. For signal transmission apparatus, such as a speaker, its box is made of the materials such as plastic, metal, wood, or ceramic, and then the speaker is embedded in the box to use the resonance effect of the box. However, a box made of ceramic for the speaker is rare. The main reason is that the ceramic manufacturing processes are complicated. The ceramic will be in a semi-melted state during the firing process under the temperature higher than 1000 degrees. During the shaping process, it is easy to cause the box to have unstable tolerances and cause extremely high scrap rate due to uncontrollable variables such as deformation, unstable shrinkage, and uneven surface.

SUMMARY OF THE INVENTION

Ceramic can be used as the shell or the box for the signal transmission apparatus, however ceramic itself has the characteristics of being easy to crack. When being impacted by external force or suddenly dropped, it may crack and cause danger. Accordingly, the present invention has developed a new design which may avoid the above-described drawbacks, may significantly enhance the performance of the apparatus and may take into account economic considerations. Therefore, the present invention then has been invented.

One object of the present invention is to provide a shell and a signal transmission apparatus using the shell. The structure of a ceramic shell body with an inner covering layer fully attached on its inner surface covers above a base having a signal transmission device on a top portion, so that the signals can pass through the ceramic shell and the signal transmission device can receive or transmit the signals. And by the fully strong connection between the inner covering layer and the ceramic shell body, to avoid being broken into a lot of ceramic debris to ensure safe use.

In order to achieve the above described invention purpose, a cavity is formed inside the shell of the present invention, wherein the cavity is in communication with an opening of a bottom portion of the shell, and the shell comprises a ceramic shell body and an inner covering layer. The inner covering layer is fully attached to an inner surface of the ceramic shell body. The signal transmission apparatus further comprises a base, wherein a top portion of the base has a signal transmission device. The shell is covered above the base.

In implementation, the shell further comprises a plurality of through holes penetrating through the shell, wherein the plurality of through holes is in communication with the cavity inside the shell; the signal transmission device is a speaker.

In implementation, the inner covering layer is formed by hardening a liquid resin fully attached to the inner surface of the ceramic shell body.

In implementation, the present invention further comprises an outer covering layer, wherein the outer covering layer is covered on an outer surface of the ceramic shell body.

For further understanding the characteristics and effects of the present invention, some preferred embodiments referred to drawings are in detail described as follows.

DETAILED DESCRIPTIONS OF PREFERRED EMBODIMENTS

Figure 1:
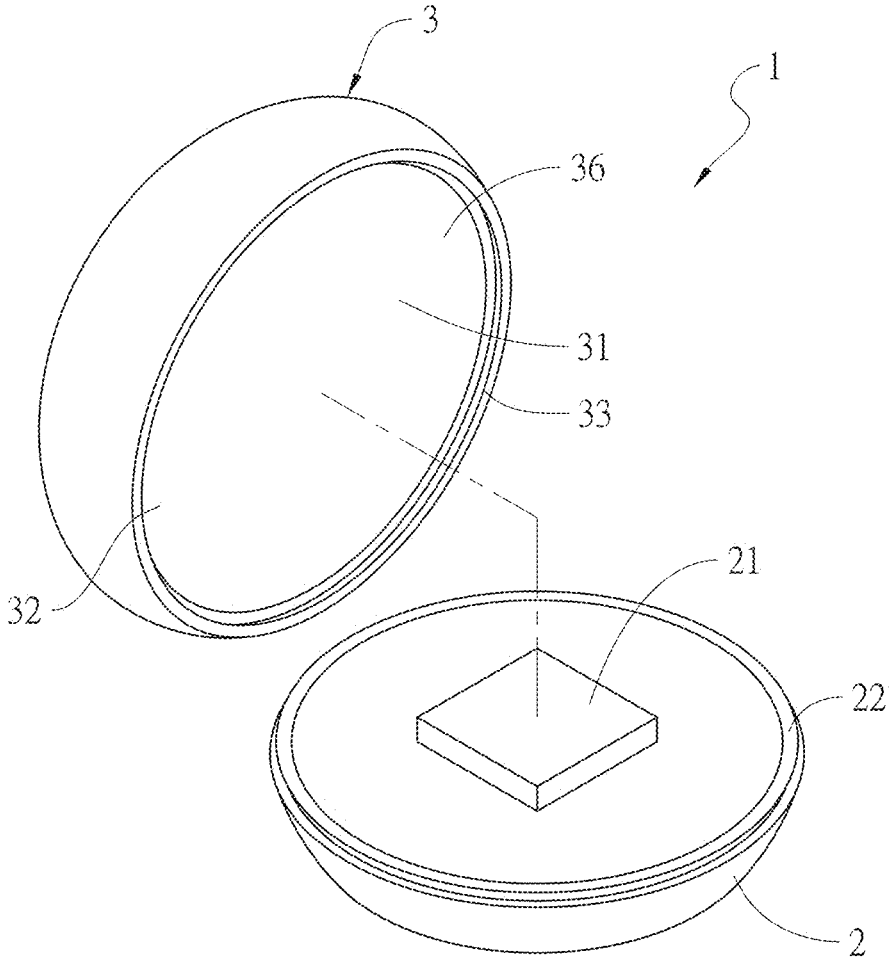
FIG. 1 is the exploded view showing the component parts of the first embodiment of the present invention.
Figure 2:
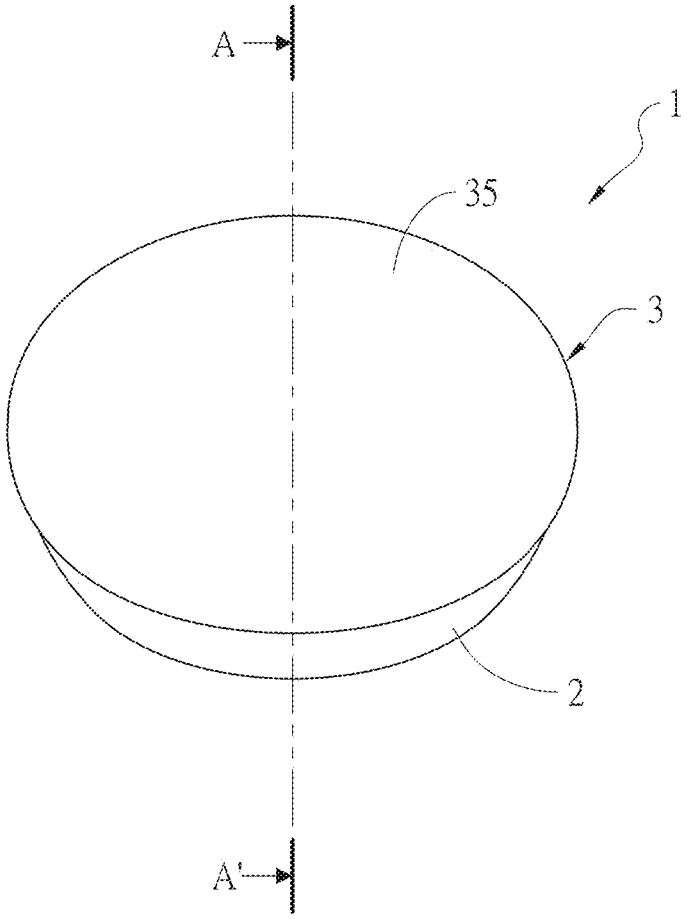
FIG. 2 is the perspective schematic view of the first embodiment of the present invention.
Figure 3:
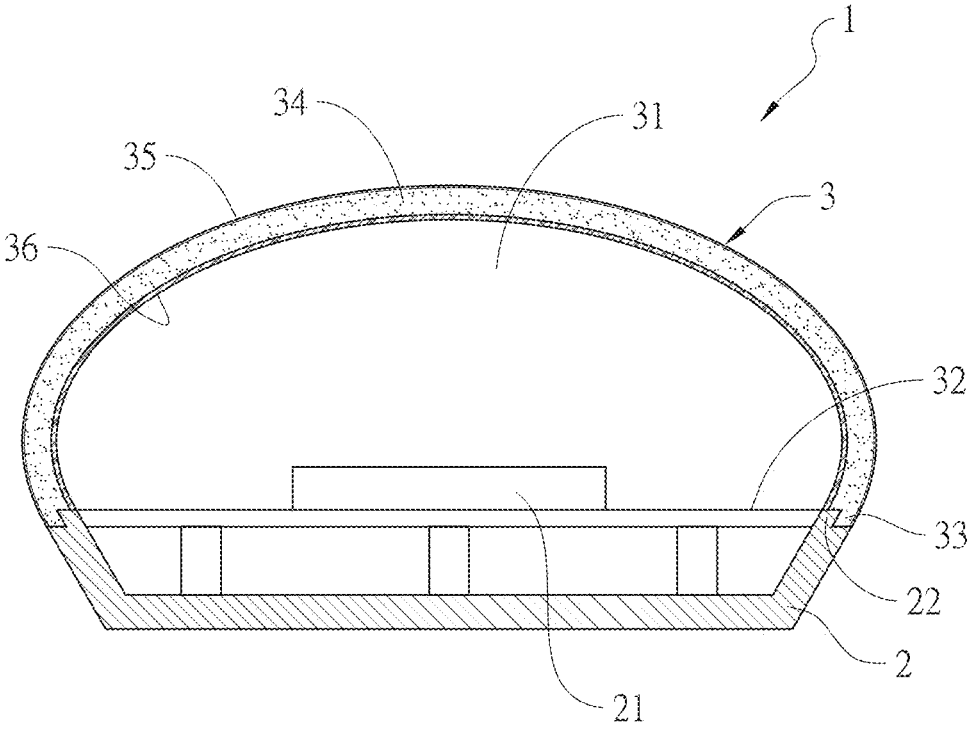
FIG. 3 is the cross-sectional view along A-A' of FIG. 2.

Please refer to FIGS. 1-3, which show the first embodiment of a signal transmission apparatus 1 of the present invention. The signal transmission apparatus 1 mainly comprises a base 2 and a shell 3. The base 2 is a disk. A top portion of the disk has a transceiver provided for receiving electromagnetic signals or transmitting electromagnetic signals. The transceiver is used as a signal transmission device 21. A periphery of a top portion of the base 2 has a step-shaped first connection portion 22. The shell 3 is roughly bowl-shaped. A cavity 31 is formed inside the shell 3. A bottom portion of the shell 3 forms a round opening 32. The round opening 32 is in communication with the cavity 31. A periphery of a bottom portion of the shell 3 has a step-shaped second connection portion 33. The shape of the second connection portion 33 is corresponding to the shape of the first connection portion 22, so that the shell 3 is covered above the base 2 with the opening 32 of the shell 3 facing downward.

The shell 3 comprises a ceramic shell body 34, an outer covering layer 35 and an inner covering layer 36. The ceramic shell body 34 is one-piece manufactured with clay. Its thickness is about 5 mm-15 mm so that the overall weight can be reduced. After molded, a glaze layer is coated on an outer surface of the semi-finished ceramic product. The glaze layer is used as the outer covering layer 35. The ceramic shell body 34 is produced after firing the semi-finished ceramic product at high temperature. An inner surface of the ceramic shell body 34 has a plurality of capillary pores. The inner covering layer 36 is formed by coating a liquid resin fully attached to the inner surface of the ceramic shell body 34 and hardening it for a period of time. Its thickness is about 0.3 mm-10 mm. When the liquid resin is coated on the inner surface of the ceramic shell body 34 by spraying or painting, the liquid resin is capable of infiltrating into the plurality of capillary pores of the inner surface of the ceramic shell body 34 so that the inner covering layer 36 and the inner surface of the ceramic shell body 34 form a large area and comprehensive strong connection. Therefore, when the shell 3 is broken due to being impacted, dropped or other reasons, the ceramic shell body 34 can be kept intact without being broken into a lot of debris of the ceramic shell body 34 to bring to user danger.

Figure 4:
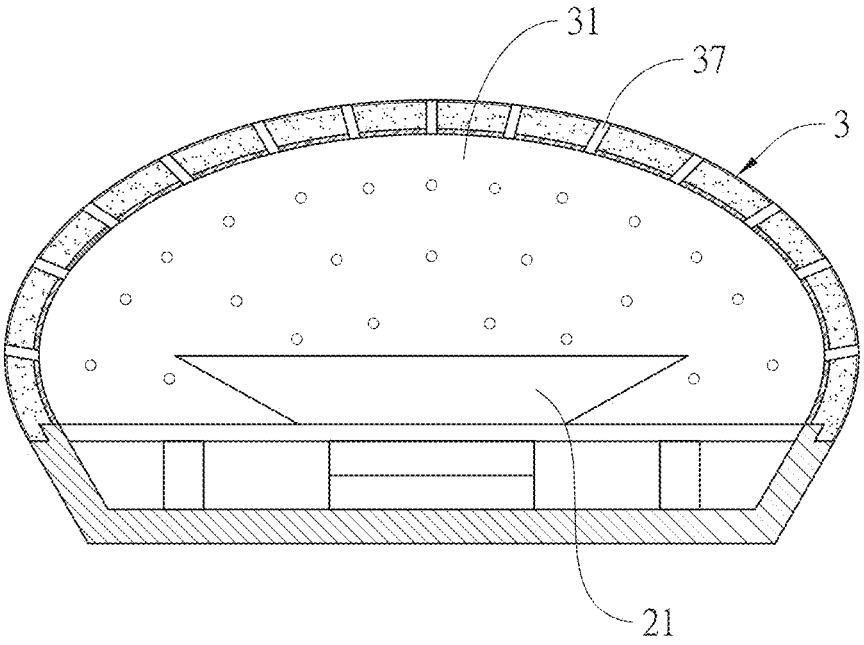
FIG. 4 is the assembly cross-sectional view of the second embodiment of the present invention.

Please refer to FIG. 4, which shows the second embodiment of the signal transmission apparatus 1 of the present invention. It differs from the first embodiment in that: the shell 3 further comprises a plurality of through holes 37 penetrating through the shell 3, and the plurality of through holes 37 is in communication with the cavity 31 inside the shell 3. The signal transmission device 21 is a speaker. Therefore, when the present invention receives the Bluetooth signals or the signals input directly from the outside of the signal transmission apparatus 1, the speaker can make sound, and then spread it out loudly through the plurality of through holes 37. In implementation, the shell 3 can also be used as a protection cover for communication products, such as mobile phone, to protect the mobile phone and allow the antenna of the mobile phone to receive or transmit signals.

Hence, the present invention has following advantages:

1. The shell of the present invention is mainly composed of the ceramic shell body, and the outer surface of the ceramic shell body has the glaze layer. Therefore, not only can the signals pass through the ceramic shell body so that the signal transmission device can receive or transmit signals, but also can the texture be effectively increased, thereby increasing product sales.
2. The inner surface of the ceramic shell body of the present invention has a certain thickness of the resin layer. Therefore, not only can it effectively decrease the thickness of the ceramic shell body to reduce the overall weight and reduce production cost, but also can it avoids being broken into a lot of ceramic debris to ensure safe use when the thin ceramic shell body broke up.

As disclosed in the above description and attached drawings, the present invention can indeed achieve the expected object and provide a shell and a signal transmission apparatus using the shell which can receive or transmit signals, and can let the resin layer and the inner surface of the ceramic shell body form effective and strong connection, and can avoid the danger of ceramic shell cracking to ensure user safety. It is new and can be put into industrial use.

Although the embodiments of the present invention have been described in detail, many modifications and variations may be made by those skilled in the art from the teachings disclosed hereinabove. Therefore, it should be understood that any modification and variation equivalent to the spirit of the present invention be regarded to fall into the scope defined by the appended claims.

What is claimed is:

1. A shell, wherein a cavity is formed inside said shell, said cavity is in communication with an opening of a bottom portion of said shell, and said shell comprises a ceramic shell body and an inner covering layer, said inner covering layer is formed by hardening a liquid resin and fully attached to an inner surface of said ceramic shell body, wherein a thickness of said inner covering layer is greater than or equal to 0.3 mm and less than or equal to 10 mm.

2. The shell according to claim 1, further comprising a plurality of through holes, wherein said plurality of through holes is in communication with said cavity.

3. The shell according to claim 1, further comprising an outer covering layer, wherein said outer covering layer is covered on an outer surface of said ceramic shell body, and wherein said outer covering layer is a glaze layer.

4. The shell according to claim 1, wherein a thickness of said ceramic shell body is greater than or equal to 5 mm and less than or equal to 15 mm.

5. A signal transmission apparatus, comprising:

a base, wherein a top portion of said base has a signal transmission device; and a shell covering above said base, wherein a cavity is formed inside said shell, said cavity is in communication with an opening of a bottom portion of said shell, and said shell comprises a ceramic shell body and an inner covering layer, said inner covering layer is formed by hardening a liquid resin and fully attached to an inner surface of said ceramic shell body, wherein a thickness of said inner covering layer is greater than or equal to 0.3 mm and less than or equal to 10 mm.

6. The signal transmission apparatus according to claim 5, wherein said shell further comprises a plurality of through holes penetrating through said shell, said plurality of through holes is in communication with said cavity inside said shell; said signal transmission device is a speaker.

7. The signal transmission apparatus according to claim 5, wherein said shell further comprises an outer covering layer, wherein said outer covering layer is covered on an outer surface of said ceramic shell body, wherein said outer covering layer is a glaze layer.

8. The signal transmission apparatus according to claim 5, wherein a thickness of said ceramic shell body is greater than or equal to 5 mm and less than or equal to 15 mm.

* * * * *